United States Patent [19]

Robinson et al.

[11] 3,992,969

[45] Nov. 23, 1976

[54] CHANGEABLE PRESET SYSTEM FOR ELECTRONIC ORGANS

[75] Inventors: John William Robinson; Billy Joe Whittington, both of Jasper, Ind.

[73] Assignee: Kimball International, Inc., Jasper, Ind.

[22] Filed: June 18, 1975

[21] Appl. No.: 588,065

[52] U.S. Cl. ..... 84/1.01; 84/1.11; 84/1.17; 84/1.19

[51] Int. Cl.[2] ..... G10H 1/00

[58] Field of Search ..... 84/1.19, 1.17, 1.11, 84/1.01, DIG. 9, 85, 343, 344, 1.03

[56] References Cited

UNITED STATES PATENTS

| | | | |
|---|---|---|---|
| 3,172,939 | 3/1965 | Campbell et al. | 84/1.01 X |
| 3,213,179 | 10/1965 | Clauson | 84/1.03 |
| 3,422,718 | 1/1969 | Noehren | 84/1.03 X |
| 3,646,241 | 2/1972 | Ott | 84/1.17 X |
| 3,833,750 | 9/1974 | Iorio | 84/1.17 X |

*Primary Examiner*—Ulysses Weldon
*Attorney, Agent, or Firm*—Melvin A. Crosby

[57] ABSTRACT

An electronic organ having voice selector means and a memory arrangement connected to the voice selector means which can be preset and which is under the control of preset switches. Each preset switch, when actuated, makes a respective preselected group of one or more voices effective while making the others of the voices ineffective. The preselected voices in any group can be varied at the will of the player.

4 Claims, 3 Drawing Figures

CHANGEABLE PRESET SYSTEM FOR ELECTRONIC ORGANS

The present invention relates to electronic organs and is particularly concerned with an adjustable, or variable, preset system for electronic organs which permits the player to select the particular voices pertaining to any group under the control of a preset switch and to change the voices pertaining to any such group at will.

Electronic organs, as is known, have a plurality of voices which are obtained by circuits that modify the wave shape, or form, of the tone signal passing therethrough thereby to obtain various audible effects at the organ speaker. Such voice circuits are under the control of tab switches which, in the ON position, make the respective voices effective and, when in the OFF position, make the respective voices ineffective.

Various preset arrangements, or systems, have been provided for in organs, including electronic organs, and these comprise control elements, such as piston type switches or the like, which control the voice circuits. Conventionally, each such preset arrangement controls certain voice circuits which are selected at the time the organ is manufactured so that, if an organ is provided with, for example, four preset piston type switches, each switch will always control the same respective set or group of voice circuits.

The present invention has, as a particular object, the provision of a preset system, especially for electronic organs, in which the organ player can select the voice circuits pertaining to any preset control element and can, furthermore, change the particular voice circuit controlled by the respective element at will.

BRIEF SUMMARY OF THE INVENTION

In general, the present invention involves the use of memory circuits connected to each voice circuit control terminal with each memory circuit being adapted to store therein the enabling signal that is supplied to the voice circuit control terminal. Each terminal is also connected to a respective tab switch for manual control of the voice circuits individually.

When the signals are thus stored in the memory circuits, the memory circuits are enabled by preset piston switches to supply the enabling signals stored therein to the respective voice circuit control terminals. The memory circuits are provided with an erase switch whereby all memories therein can be erased and with a write switch whereby enabling signals can be stored in the selected ones of the memory circuits.

Each present piston switch has memory circuits connected thereto which are, in turn, connected to the various voice circuit control terminals so that each preselect piston switch is effective for controlling a plurality of preselected voices.

When a piston switch is actuated, the tab switches are all made ineffective and the voice circuits are under the control of the memory circuit.

The exact nature of the present invention will become more apparent upon reference to the following detailed specification taken in connection with the accompanying drawings in which:

FIG. 1 schematically illustrates a greatly simplified organ circuit.

DETAILED DESCRIPTION OF THE INVENTION

Figure 1:
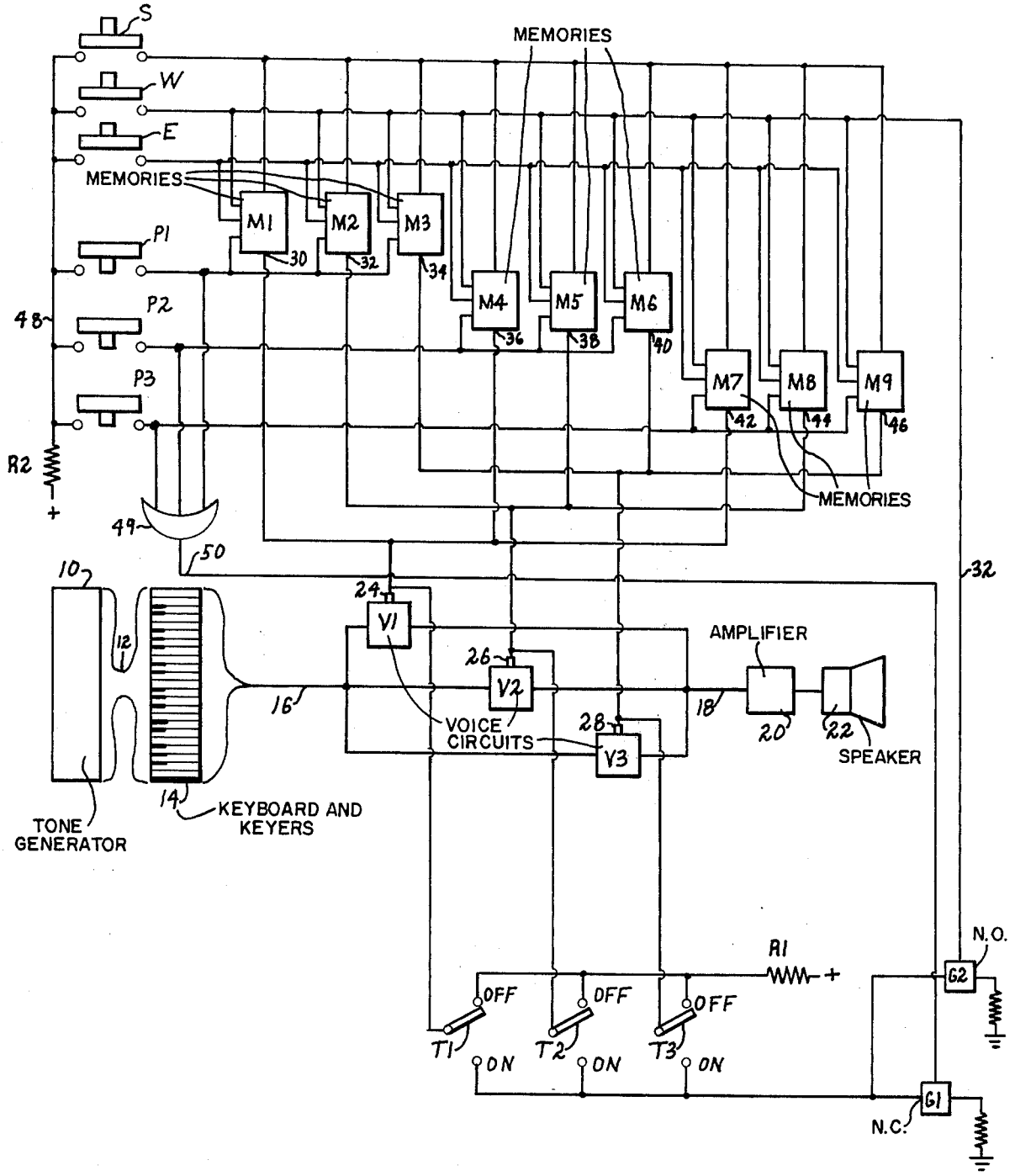

Referring to the drawings somewhat more in detail, in FIG. 1, 10 represents a tone generator generating a plurality of frequencies distributed according to the steps of the diatonic scale. The output side of generator 10 is connected by a cable 12 to keyers under the control of the keys of a keyboard 14 while the output sides of the keyers are connected by wire 16 to the input sides of voice circuits V1, V2 and V3 which are connected in parallel with the output sides being connected by wire 18 to an amplifier means 20 which is, in turn, connected to a speaker means 22.

Voicing circuits V1, V2 and V3 have control terminals 24, 26 and 28, respectively, which, when supplied with a plus, or logic 1, voltage signal, cause the respective circuits to be ineffective, and when supplied with a logic 0 signal, cause the respective circuits to be effective.

Each control terminal is connected to the blade of a respective tab switch T1, T2 and T3, each of which has an upper or OFF position wherein the tab is connected to a source of positive voltage by way of a resistor R1. Each tab has a lower or ON position wherein the tab is connected through a normally closed circuit component G1 with ground.

The circuit of the present invention comprises memory circuits M1 through M9, which have output terminals 30 through 46, respectively. Output terminal 30 of memory M1, output terminal 36 of memory M4 and output terminal 42 of memory M7 are connected to control terminal 24 of voice circuit V1. Similarly, output terminal 32 of memory M2, output terminal 38 of memory M5 and output terminal 44 of memory M8 are connected to control terminal 26 of voice circuit V2. Output terminal 34 of memory M3, output terminal 40 of memory M6 and output terminal 46 of memory M9 are connected to control terminal 28 of voice circuit V3.

A start switch S is provided having one side connected to a wire 48 and therefrom through a resistor R2 to a source of positive voltage and the other side connected to each of the memory circuits. Start switch S may be electronic and operated in response to turning on the power to the organ. A write switch W, similarly, has one side connected to wire 48 and the other side connected to each memory circuit and an erase switch E is also provided connected between wire 48 and each of the memory circuits.

A piston switch P1 is connected between wire 48 and memory circuits M1, M2 and M3; a piston switch P2 is connected between wire 48 and memory circuits M4, M5 and M6; and a piston switch P3 is connected between wire 48 and memory circuits M7, M8 and M9.

An OR gate 49 has one terminal connected to the memory circuit side of each of the piston switches while the output side is connected by wire 50 to the control terminal of component G1. Component G1 is normally conductive and goes nonconductive in response to the supply of a signal thereto from gate 49.

A normally nonconductive component G2 is connected in parallel with component G1 and has a control terminal connected to the memory circuit side of write switch W.

Figure 2:
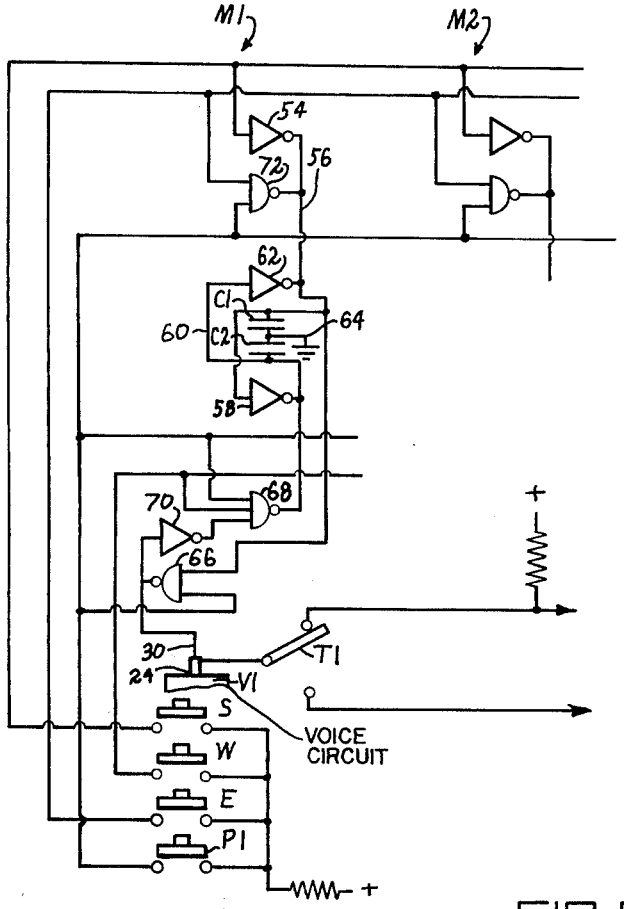
FIG. 2 is a schematic representation of a portion of the preset system of the present invention showing a typical memory circuit.

Each of the memory circuits of FIG. 1 is constructed as is shown in FIG. 2 which illustrates memory circuits M1 and M2. The following detailed description pertains to memory circuit M1 but, as will be seen, memory circuit M2, and all of the other memory circuits, are constructed in the same way.

Commencing at the top of memory circuit M1, there is an invertor 54 having an input side connected to start switch S so that when the start switch is closed to supply a logic 1 to the input side of invertor 54, the output side thereof, and which is connected to wire 56, will go to logic 0.

Wire 56 is connected to the input side of another invertor 58, the output side of which is connected by a wire 60 to the input side of still another invertor 62, the output side of which is connected to wire 56. The invertors, connected as described and shown, form a memory circuit in which a signal can be locked to be impressed on wire 56. Capacitors C1 and C2 connected in series between the input sides of invertors 58 and 62 and the ground connection at 64 taken from between the capacitors forms means for suppressing transient spikes.

Wire 56 is connected to one input of a two input NAND gate 66, the other input of which is connected to piston switch P1. As long as there is a logic 0 on wire 56, there will be a logic 1 at the output side of NAND gate 66. The output side of NAND gate 66 is connected to the output terminal 30 of memory circuit M1 and is, thus, ineffective for controlling voice circuit V1 which is, instead, under the control of tab switch T1.

Memory circuit M1 also includes a three input NAND gate 68 having one input terminal connected to each of piston switch P1 and write switch W. The output side of NAND gate 66 is connected through a further invertor 70 with the third input of NAND gate 68. Finally, erase switch E and piston switch P1 are connected to the inputs of a two input NAND gate 72, the output side of which is connected to wire 56.

In operation, assuming that wire 56 is at 0, the output side of NAND gate 66 will be at 1 and voicing circuit V1 connected to output terminal 30 can be controlled by tab switch T1 which, in its lower position, drives the control terminal 24 of the voice circuit to an effective logic 0 level while in its upper position the control terminal is driven to a logic 1 level thereby making the voicing circuit ineffective.

If, now, with tab switch T1 in its ON position, write switch W and piston switch P1 are both depressed, three logic 1's will be supplied to the input side of NAND gate 68 thereby driving the output side to 0 and setting the memory circuit, consisting of invertors 58 and 62, to hold wire 56 at a logic 1.

The wire switch is now released, and if piston switch P1 is opened, the voice circuit V1 will remain under the control of tab switch T1.

However, if piston switch P1 is again closed, logic 1 will be supplied to both of the inputs of NAND gate 66 thereby driving the output terminal 30 of memory circuit M1 to logic 0, pulling control terminal 24 of voice circuit V1 down to 0 and making the respective voicing circuit V1 effective. At the same time, as will be seen upon reference to FIG. 1, component G1 becomes nonconductive and, thus, interrupts the control of all of the tab switches over the respective voices.

Thus, when switch P1 is closed, only those memory circuits holding a 1 on the respective NAND gate 66 at the output side will be effective for controlling voice circuits. Release of piston switch P1 will return all of the voice circuits to the control of the respective tabs regardless of the condition of the memory circuits pertaining to piston switch P1.

In order to erase memories, piston switch P1 and erase switch E are closed, and this will supply logic 1's to both inputs of NAND gate 72, driving its output to 0, thus, restoring the memory to that condition in which wire 56 is held at 0.

It will be seen that memory can be written in or erased at will so that by the simple circuit arrangement illustrated, a player can select different groups of voices for each preset switch and can call the voices in at will and can, furthermore, change the particular group of voices pertaining to any of the piston switches.

The piston switches may be of the type that remain in actuated position once depressed and which release when again depressed and may, furthermore, be interlocked so that the depressing of one piston switch will release any others thereof that are actuated. The pistons can also operate electronic latches whereby momentary piston actuation is all that is needed.

It will be apparent that, during a write operation, it is desired for the tab switches which are in ON position to be effective so that the input side of invertor 70 is held at the proper level for a writing operation. Since the component G1 is provided which interrupts the connection of the tab switches to ground when any of the piston switches are closed, the further component G2 is provided which will connect the tab switches to ground whenever the write switch is closed. After the write switch is released, of course, component G1 again becomes effective for interrupting the connection of all of the tab switches to ground whenever a piston switch is actuated.

Figure 3:
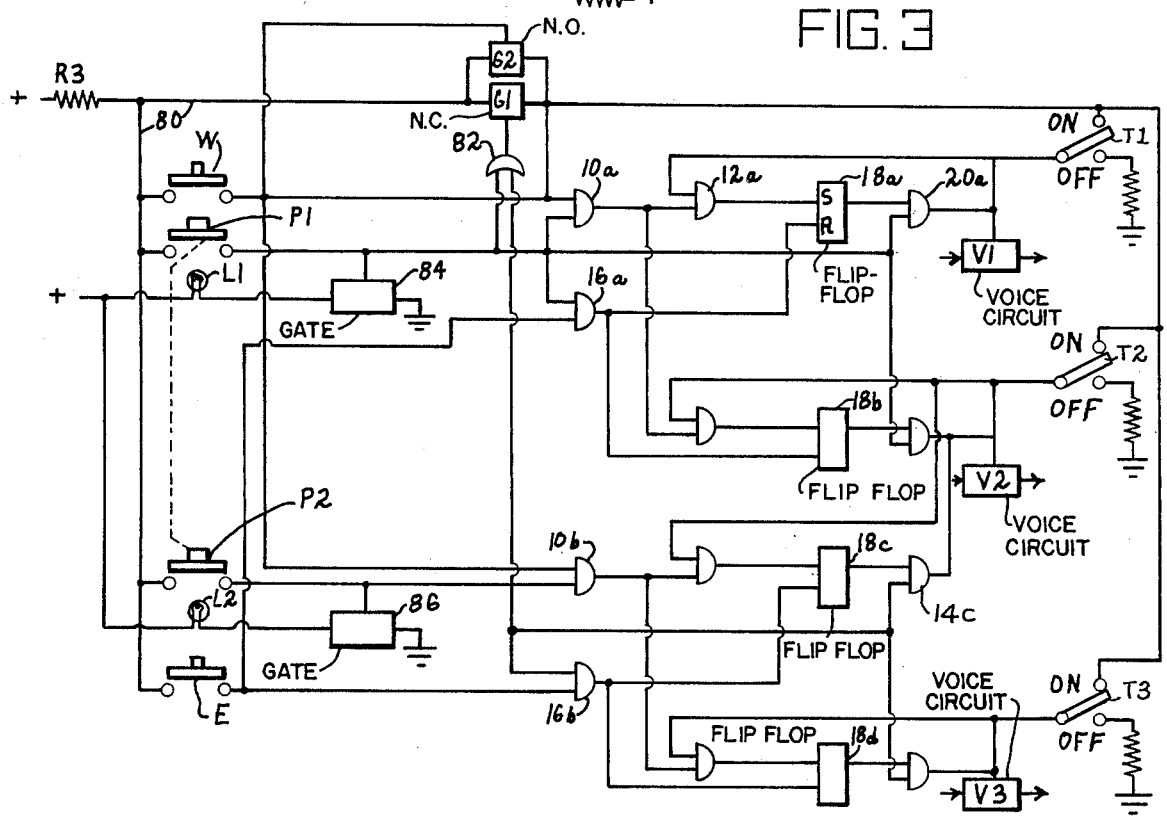
FIG. 3 is a schematic view similar to FIG. 2 but showing a different type memory circuit.

FIG. 3 shows a modified arrangement in which the voice circuits are under the control of positive voltage signals and wherein the memory circuits comprise RS flip-flops.

In FIG. 3, a source of plus voltage is connected by a resistor R3 to wire means 80 leading to one side of each of write switch W, erase switch E and piston switches P1 and P2. Wire means 80 is also connected through components G1 and G2 to the ON terminal of each of tab switches T1, T2 and T3, each switch having an OFF terminal where the blade is grounded. The blade of each tab switch is connected to the control terminal of a respective voice circuit V1, V2 and V3, each of which is effective when the control terminal goes to logic 1 and becomes ineffective when the control terminal goes to logic 0.

The write switch W is connected on one side to wire means 80 and on the other side to one input terminal of each of the two input AND gates **10*a* and 10*b* with the other input of AND gate 10*a* connected to piston switch P1 and the other input of AND gate 10*b*** connected to piston switch P2.

The output side of AND gate **10*a* forms one input of an AND gate 12*a*, the other input of which is connected to the blade of tab switch T1 and with the output of AND gate 12*a* being connected to the S terminal of a flip-flop 18*a*. The flip-flop 18*a* has an output terminal connected to one input of AND gate 20*a***, the other input of which is connected to piston switch P1 while the output terminal thereof is connected to the control terminal of voice circuit V1.

The erase switch E is connected between wire means 80 and an input terminal of AND gate 16*a* with the other input terminal thereof being connected to piston switch P1 while the output terminal of gate 16*a* is connected to the reset terminal of flip-flop 18*a*.

The flip-flop 18*b* is similarly connected to the control terminal of voice circuit V2 and is under the control of write switch W and piston switch P1 and has the reset terminal connected to the output side of gate 16*a*.

The flip-flop at 18*c* is under the control of piston P2 and through AND gate 14*c* is connected to the control terminal of voice circuit V2 while a further flip-flop at 18*d* is similarly connected to the control terminal of a switch could circuit V3. Each of the last mentioned flip-flops has the reset terminal connected to the output side of an AND gate 16*b* having one input connected to erase switch E and the other input connected to piston P2. In the arrangement illustrated in FIG. 3, the number of memory circuits can be expanded as was shown in FIG. 1 so that each piston could control any of the voices represented by the voice circuits.

Similarly, as shown in the FIG. 1 arrangement, when either piston switch is depressed an OR gate 82 supplies a signal to component G1 which interrupts the voltage supply to the tab switches thereby making the tab switches ineffective.

Component G1 is bypassed by a normally non-conductive component G2 which goes conductive when write switch W is closed thereby making the tab switches effective for writing-in purposes when the enabling signals for the voice circuits pertaining to the piston switches are to be written into the respective flip-flops.

The arrangement of FIG. 3, as well as that of FIGS. 1 and 2, could have lamps L1 and L2 associated with the piston switches and supplied on one side from a voltage source V and connected to ground on the other sides through respective components 84 and 86 which go to conduction when the respective piston switch is in closed position and which go to nonconduction when the respective piston switch is open.

The arrangement of FIG. 3 differs from that of FIG. 2 in employing positive logic and has the same characteristics in that a memory can be selectively actuated to store therein an enabling signal for a voice circuit and which signal can be selectively employed for controlling a respective voice circuit. In each case, any voice circuit not supplied with an enabling signal from a memory becomes ineffective when a piston switch is closed.

It will be apparent that the system according to the present invention can be expanded to control all of the voices in an organ or it can selectively control only the voices pertaining to the solo and accompaniment manuals or even to a single one thereof.

It will also be apparent that by the provision of battery means, such as a rechargeable battery, the memories could be retained after an organ was turned off as long as the off period for the organ did not exceed the charge life of the battery. Normally, however, an organist will select the various groups of voices for the respective piston switches at the time of turning the organ on.

Modifications may be made within the scope of the appended claims.

What is claimed is:

1. In an electronic organ having a tone generator and an electroacoustic transducer and keying means connecting the generator to the transducer and voice circuits interposed between the keying means and the transducer with each voice circuit having a voltage sensitive control terminal responsive to a first voltage signal to make the respective voice circuit effective and to a second voltage signal to make the respective voice circuit ineffective, a tab switch connected to each control terminal and having respective positions in which a respective one of said first and second voltage signals is supplied to the respective control terminal; a group of memory circuits which can assume a first and second voltage conditions and each having an output terminal connected to one control terminal, a control switch for each group of memory circuits, a write switch connected to all of said memory circuits, means responsive to actuation of said write switch while a said control switch is also actuated to cause those memory circuits of the group pertaining to the respective control switch and having tab switches in said first position to go to said first voltage condition thereof, an erase switch connected to said memory circuits, and means responsive to actuation of said erase switch while a said control switch is actuated for causing all of the memory circuits in the respective group thereof to go to the said second voltage condition thereof.

2. An electronic organ according to claim 1 which includes means operated by actuation of a control switch and effective during the period of actuation of a control switch for disconnecting the source of first voltage signals from said tab switches.

3. An electronic organ according to claim 1 which includes means operated by actuation of said write switch and effective during the period of actuation of the write switch for connecting the source of first voltage signals to said tab switches.

4. An electronic organ according to claim 1 which includes a plurality of voice circuits each having a control terminal, each group of memory circuits being equal in number to the number of voice circuits and each having an output terminal, and the output terminal of each memory circuit of each group being connected to a respective control terminal.

* * * * *